US009435190B2

(12) United States Patent
Mulholland et al.

(10) Patent No.: US 9,435,190 B2
(45) Date of Patent: Sep. 6, 2016

(54) WIRELESS COMMUNICATION SYSTEM FOR MONITORING OF SUBSEA WELL CASING ANNULI

(75) Inventors: John J. Mulholland, Dunfermline (GB); Corey Jaskolski, Severance, CO (US); Gabriel Silva, Kingwood, TX (US)

(73) Assignee: FMC Technologies, Inc., Houston, TX (US)

( * ) Notice: Subject to any disclaimer, the term of this patent is extended or adjusted under 35 U.S.C. 154(b) by 696 days.

(21) Appl. No.: 13/812,130

(22) PCT Filed: Aug. 5, 2010

(86) PCT No.: PCT/US2010/002189

§ 371 (c)(1),
(2), (4) Date: Jun. 3, 2013

(87) PCT Pub. No.: WO2012/018322

PCT Pub. Date: Feb. 9, 2012

(65) Prior Publication Data

US 2013/0269945 A1 Oct. 17, 2013

(51) Int. Cl.

| | |
|---|---|
| ***E21B 47/001*** | (2012.01) |
| ***E21B 47/13*** | (2012.01) |
| ***E21B 47/00*** | (2012.01) |
| ***E21B 47/12*** | (2012.01) |

(52) U.S. Cl.
CPC ..... *E21B 47/0001* (2013.01); *E21B 47/122* (2013.01)

(58) Field of Classification Search
CPC ..... E21B 47/0001; E21B 47/122
USPC ..... 166/336, 368; 340/853.1, 854.6, 854.8
See application file for complete search history.

(56) References Cited

U.S. PATENT DOCUMENTS

| | | | | |
|---|---|---|---|---|
| 3,974,690 | A * | 8/1976 | Brock, Jr. | G01L 19/00 73/152.51 |
| 5,008,664 | A * | 4/1991 | More | E21B 34/16 166/66 |
| 5,585,790 | A | 12/1996 | Luling | |
| 7,762,338 | B2 * | 7/2010 | Fenton | E21B 33/043 166/250.01 |
| 8,511,389 | B2 * | 8/2013 | Fenton | E21B 33/0355 166/250.01 |
| 8,683,859 | B2 * | 4/2014 | Godager | E21B 41/0085 73/152.54 |

(Continued)

FOREIGN PATENT DOCUMENTS

WO WO 99/25070 A2 5/1999

OTHER PUBLICATIONS

Sultan et al., "Real-Time Casing Annulus Pressure Monitoring in a Subsea HPHT Exploration Well", OTC 19286 (May 5, 2008).

*Primary Examiner* — Matthew R Buck
(74) *Attorney, Agent, or Firm* — Henry C. Query, Jr.

(57) ABSTRACT

A non-invasive wireless communication system for monitoring parameters existing within the casing annuli of a subsea hydrocarbon production system. The subsea hydrocarbon production system includes a wellhead housing mounted at the upper end of a well bore and a number of concentric well casings extending from the wellhead housing through the well bore, and the casing annuli are formed between successive ones of the wellhead housing and the well casings The monitoring system comprises an interrogation package which is adapted to wirelessly transmit and receive NFM and/or inductive signals and at least one sensing package which is located in one of the casing annuli and is adapted to wirelessly receive the signals from and transmit response signals to the interrogation package.

20 Claims, 3 Drawing Sheets

(56) References Cited

U.S. PATENT DOCUMENTS

2001/0027865 A1* 10/2001 Wester ..... E21B 47/06
166/250.01
2008/0070499 A1 3/2008 Wilhelm et al.
2009/0066535 A1* 3/2009 Patel ..... E21B 17/028
340/853.2
2010/0159827 A1 6/2010 Rhodes et al.
2010/0174495 A1 7/2010 Pereira et al.

* cited by examiner

WIRELESS COMMUNICATION SYSTEM FOR MONITORING OF SUBSEA WELL CASING ANNULI

BACKGROUND OF THE INVENTION

The present invention relates to a system for non-intrusively and wirelessly monitoring pressure, temperature and/or other parameters in the casing annuli of a subsea hydrocarbon production system. More specifically, the invention provides an apparatus and method for monitoring the parameters in the casing annuli using a near-field magnetic or an inductive through-wall communications system to communicate with one or more sensing packages located in corresponding casing annuli.

Sustained Casinghead Pressure (SCP) is a pressure build-up within the casing annuli of a subsea hydrocarbon production system which is due solely to temperature fluctuations. The need to monitor SCP has been identified by the Minerals Management Service (MMS) of the United States Department of the Interior. However, this requirement has been waived for certain subsea hydrocarbon production systems due to other regulatory prohibitions against body penetrations in high pressure wellhead housings.

In addition to regulatory demands for the development of technology for the non-invasive monitoring of casing annuli, operators are interested in such monitoring in order to mitigate the risks to personnel, equipment and system availability which may be caused by working on equipment in an unknown pressure condition or incidents such as the collapse of production tubing due to pressure in the B annulus, i.e., the production casing annulus. Operators have experienced failures on non-High Pressure High Temperature ("HPHT") wells due to excessive pressure in the B annulus, and the risks of annulus pressure build-up and subsequent damage are more acute in HPHT wells due to thermal expansion of trapped fluid within the casing annuli.

SUMMARY OF THE INVENTION

In accordance with the present invention, a system is provided for monitoring pressure, temperature and/or other parameters within one or more subsea well casing annuli of a subsea hydrocarbon production system without physically penetrating any of the pressure barriers.

The monitoring system of the present invention may be employed with a subsea hydrocarbon production system which comprises a wellhead housing mounted at the upper end of a well bore, a number of concentric well casings extending from the wellhead housing through the well bore, including an innermost casing through which a hydrocarbon fluid is produced, and a plurality of casing annuli formed between successive ones of the wellhead housing and the well casings.

The monitoring system comprises an interrogation package which is operable to wirelessly transmit an interrogation signal, and at least one sensing package which is located in one of the casing annuli and which includes at least one sensor for sensing the parameter. The sensing package is operable to wirelessly receive the interrogation signal and in response thereto wirelessly transmit a response signal to the interrogation package which is indicative of the parameter sensed by the sensor. The interrogation package may communicate with the at least one sensing package using, for example, near-field magnetic induction (NFM) and/or inductive signals.

In one embodiment of the invention the interrogation package is located externally of the wellhead housing and the at least one sensing package comprises a single sensing package which is located in one of the casing annuli. In this embodiment, the interrogation and response signals may be transmitted directly between the interrogation package and the sensing package.

In another embodiment of the invention the interrogation package is located externally of the wellhead housing and the at least one sensing package comprises a plurality of sensing packages, each of which is located in a corresponding casing annulus. In this embodiment the interrogation and response signals may be transmitted between the interrogation package and the sensing packages using a multi-hop signal transmission technique.

In accordance with yet another embodiment of the invention, the interrogation package is located within the innermost casing and the at least one sensing package comprises a single sensing package which is located in one of the casing annuli. In this embodiment, interrogation and response signals may be transmitted directly between the interrogation package and the sensing package.

In accordance with still another embodiment of the invention, the interrogation package is located within the innermost casing and the at least one sensing package comprises a plurality of sensing packages, each of which is located in a corresponding casing annulus. In this embodiment the interrogation and response signals may be transmitted between the interrogation package and the sensing packages using a multi-hop signal transmission technique.

The present invention thus provides a system and method for the non-intrusive monitoring of pressure, temperature and/or other parameters existing within one or more casing annuli without physically penetrating any pressure barriers in the subsea hydrocarbon production system. The invention thus reduces the risks associated with, and avoids regulatory prohibitions on, pressure barrier penetrations.

These and other objects and advantages of the present invention will be made apparent from the following detailed description, with reference to the accompanying drawings. In the drawings, the same reference numbers may be used to denote similar components in the various embodiments.

DETAILED DESCRIPTION OF THE INVENTION

Figure 1:
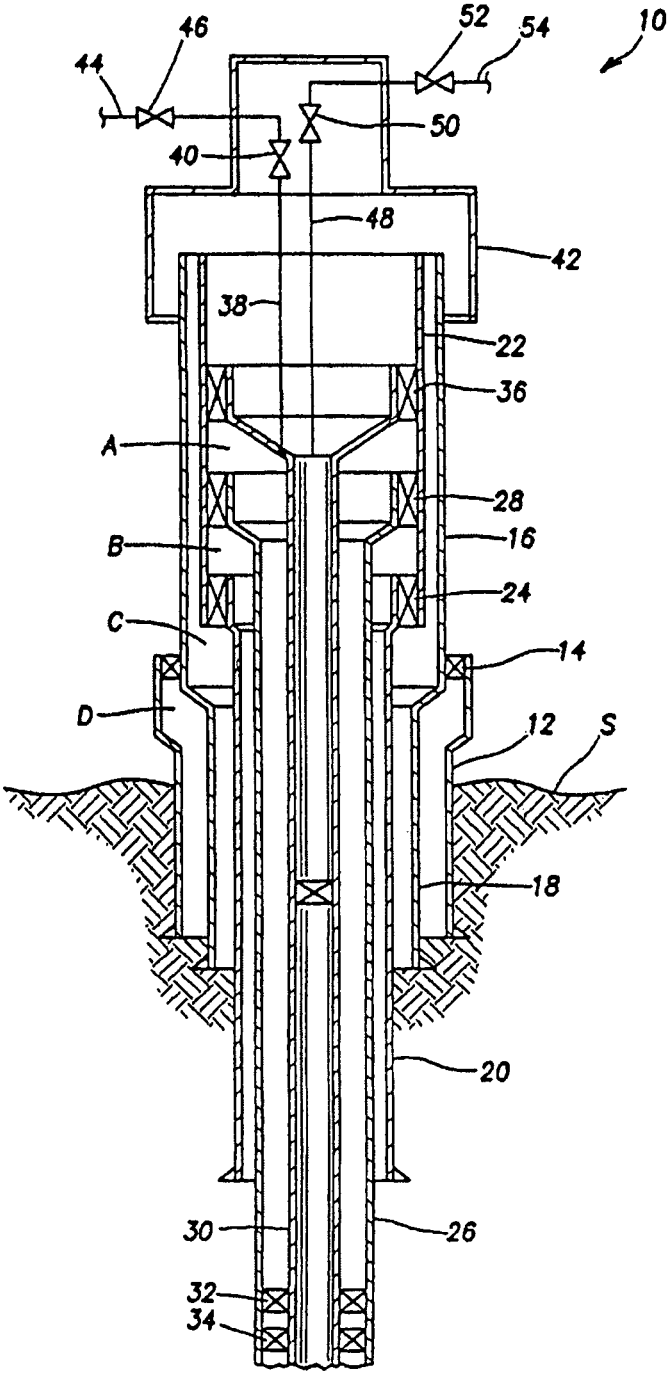
Fig. 1 (prior art)
FIG. 1 is a schematic sectional illustration of an exemplary subsea hydrocarbon production system showing a prior art system for monitoring a single casing annulus.

Conventional subsea hydrocarbon production systems generally comprise a wellhead housing which is mounted at the upper end of a well bore, a number of concentric well casings which extend from the wellhead housing through the well bore, and a plurality of casing annuli which are formed between successive ones of the wellhead housing and the well casings. Referring to FIG. 1, for example, a conventional subsea hydrocarbon production system, generally 10, includes a low pressure wellhead housing 12 which is sealed by a packer 14 to a high pressure wellhead housing 16. The high pressure wellhead housing 16 is connected to the upper end of a surface casing 18, and the annular space between the surface casing 18 and the low pressure wellhead housing 12 defines an annulus D. An intermediate casing 20 extends through the surface casing 18 and is sealed to the bore 22 of the high pressure wellhead housing 16 by a packer 24. The annular space between the intermediate casing 20 and the surface casing 18 defines an annulus C.

A production casing 26 extends through the intermediate casing 20 and is sealed to the bore 22 of the high pressure wellhead housing 16 by a packer 28. The annular space between the production casing 26 and the intermediate casing 20 defines a production casing annulus B. An innermost casing 30, which is also referred to as a production tubing, is sealed to the production casing 26 at its lower end by packers 32 and 34 and to the bore 22 of the high pressure wellhead housing 16 at its upper end by a packers 36. The annular space between the production tubing 30 and the production casing 26 defines the production tubing annulus A.

In the prior art system 10 shown in FIG. 1, pressure within the production tubing annulus A is accessed through an annulus bore 38. The annulus bore 38 is controlled by a valve 40 which is provided on a subsea tree 42 that is mounted on the high pressure wellhead housing 16. A production annulus monitoring line 44 is connected to the annulus bore 38 via a control valve 46.

The production tubing 30 is connected to a production bore 48 which is controlled by valves 50 and 52 provided on the tree 42. The valves 50, 52 control the flow of production fluid through a production outlet 54. Pressure within the production bore 48 can be measured either upstream or downstream of the valves 50 and 52.

In the conventional subsea hydrocarbon production system shown in FIG. 1, only the pressure within the production tubing annulus A is monitored. No means are provided for monitoring the pressures within the B, C and D annuli.

In accordance with the present invention, a monitoring system is provided for a subsea hydrocarbon production system for monitoring the pressure and/or other parameters existing within not only the production tubing annulus A, but also within any of a plurality of additional annuli, such as the B, C and D annuli. In the several embodiments of the invention shown in FIGS. 2 through 5, the monitoring system, generally 56, is shown to comprise an interrogation package 58 which is wirelessly linked with one or more sensing packages 60, 62 and 64 that are located in or attached to the surface casing 18, the intermediate casing 20 and the production casing 26, respectively.

The interrogation package 58 includes suitable circuitry for generating an interrogation signal, wirelessly transmitting the interrogation signal to the sensing packages 60, 62 and 64, and wirelessly receiving a response signal from the sensing packages. Each sensing package 60, 62 and 64 comprises one or more conventional sensors for sensing one or more parameters, such as pressure and temperature, existing in the casing annuli. In addition, the sensing packages include appropriate circuitry for wirelessly receiving the interrogation signal, generating the response signal, which is indicative of the sensed parameters, and wirelessly transmitting the response signal to the interrogation package 58.

Alternatively, each sensing package 60, 62 and 64 may comprise suitable circuitry for generating a signal indicative of the sensed parameters and then wirelessly transmitting the signal to the interrogation package 58 based on a preset timing scheme or a conditional trigger. In this alternative embodiment, the interrogation package 58 would not require means for generating an interrogation signal and transmitting the interrogation signal to the sensing packages 60, 62 and 64, and the sensing packages would not require means for wirelessly receiving an interrogation signal from the interrogation package. Rather, the interrogation package 58 simply "listens" for the signals which are periodically or otherwise generated by the sensing packages 60, 62 and 64.

In one embodiment of the invention, the monitoring system 56 employs a near-field magnetic induction (NFM) communication system to communicate the interrogation and response signals between the interrogation and sensing packages. As described more fully in U.S. Patent Application Publication No. US 2008/0070499 A1, which is hereby incorporated herein by reference, the NFM communication system employs short range (i.e., less than two meters), wireless signals which are coupled by a low power, non-propagating magnetic field that is established between the interrogation and sensing packages. A transmitter coil in one package generates a magnetic field which is measured by a receiver coil in another package. NFM induction is used in the present invention to obtain wireless communication through the well casing walls by creating a localized communications zone around the interrogation and sensing packages which is immune from RF interference. In another embodiment of the invention, the monitoring system 56 employs a conventional conductive communications system to communicate the interrogation and response signals between the interrogation and sensing packages.

Figure 2:
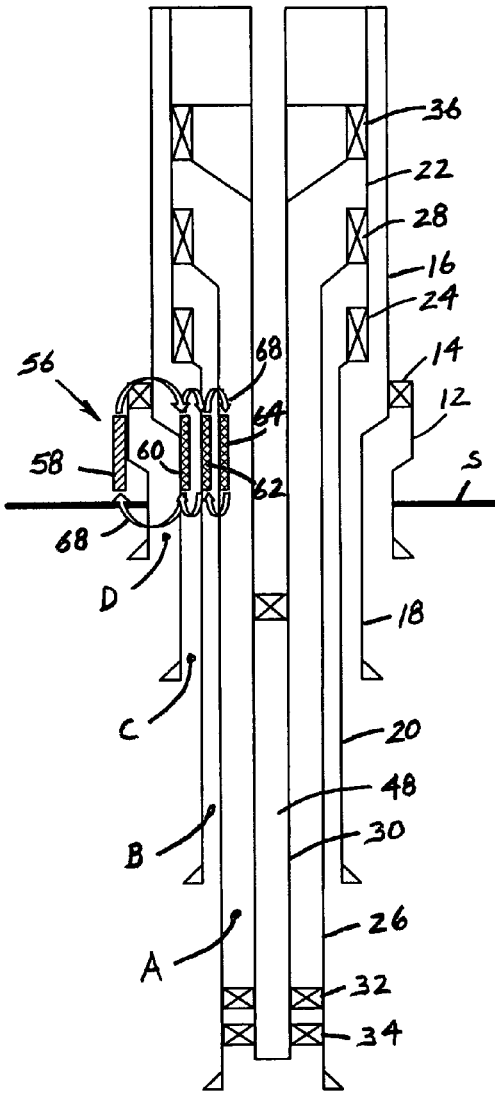
FIG. 2 is a schematic sectional illustration of an exemplary subsea hydrocarbon production system showing an interrogation package located outside the wellhead housing and communicating via a multi-hop technique with sensing packages located in the A, B and C annuli.

In the embodiment of the invention shown in FIG. 2, the interrogation package 58 is positioned outside the low pressure wellhead housing 12, and the interrogation and response signals are transmitted between the interrogation package and the internal sensing packages 60, 62 and 64 using a multi-hop signal transmission technique between sensing packages, as shown by the arrows 68.

Figure 3:
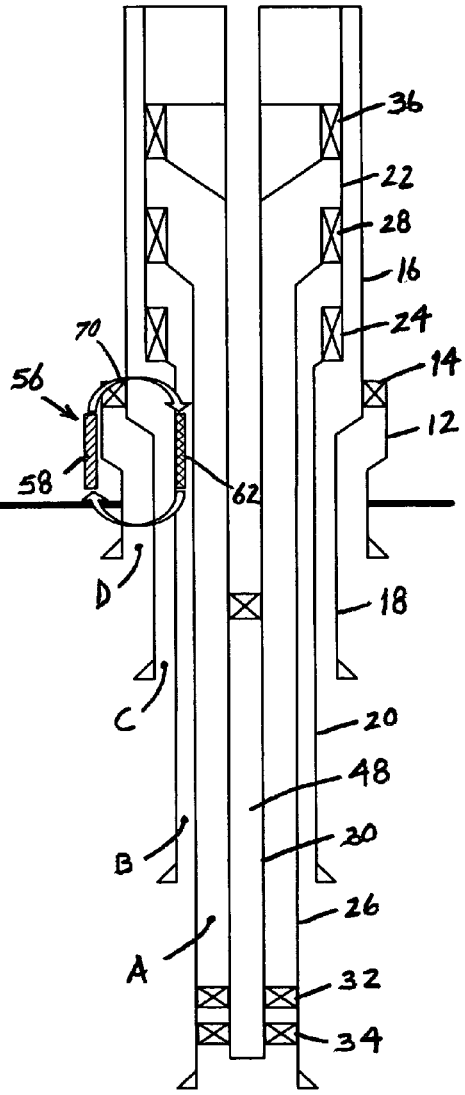
FIG. 3 is a schematic sectional illustration of an exemplary subsea hydrocarbon production system showing an interrogation package located outside the wellhead housing and communicating via a multi-barrier technique with a sensing package located in the B annulus.

In the embodiment of the invention shown in FIG. 3, the interrogation package 58 is located outside the low pressure wellhead housing 12, and the interrogation and response signals are transmitted directly across multiple well casings and annuli, as shown by the arrow 70.

Figure 4:
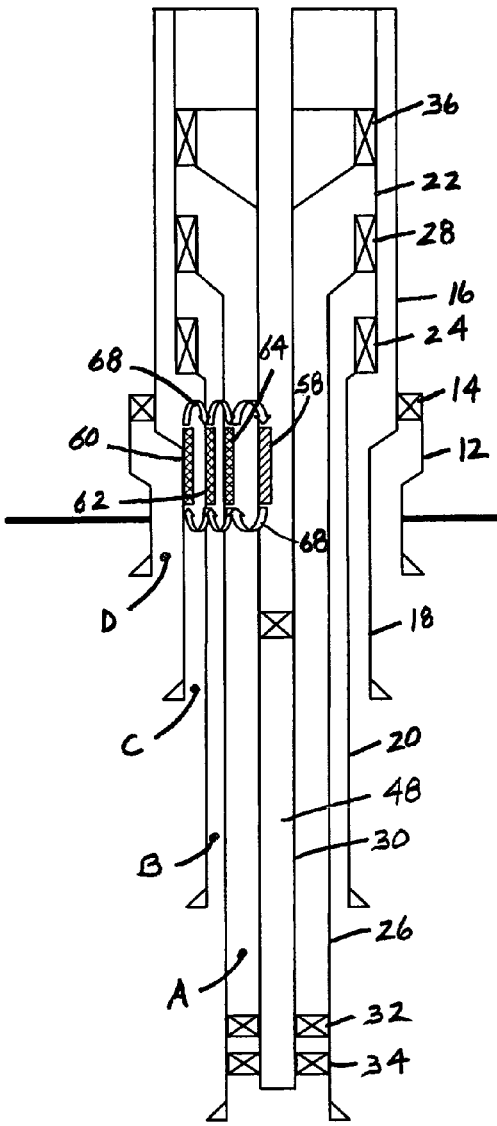
FIG. 4 is a schematic sectional illustration of an exemplary subsea hydrocarbon production system showing an interrogation package located inside the production bore and communicating via a multi-hop technique with sensing packages located in the A, B and C annuli.

In the embodiment of the invention shown in FIG. 4, the interrogation package 58 is located in the production bore 48, rather than outside the low pressure wellhead housing pipe 12, and the sensing packages 60, 62 and 64 are located in or attached to the surface casing 18, the intermediate casing 20 and the production casing 26, respectively. As with the embodiment of the invention shown in FIG. 2, this embodiment employs a multi-hop signal transmission technique between the sensing packages 60, 62, 64 and the interrogation package 58, as indicated by the arrows 68.

Figure 5:
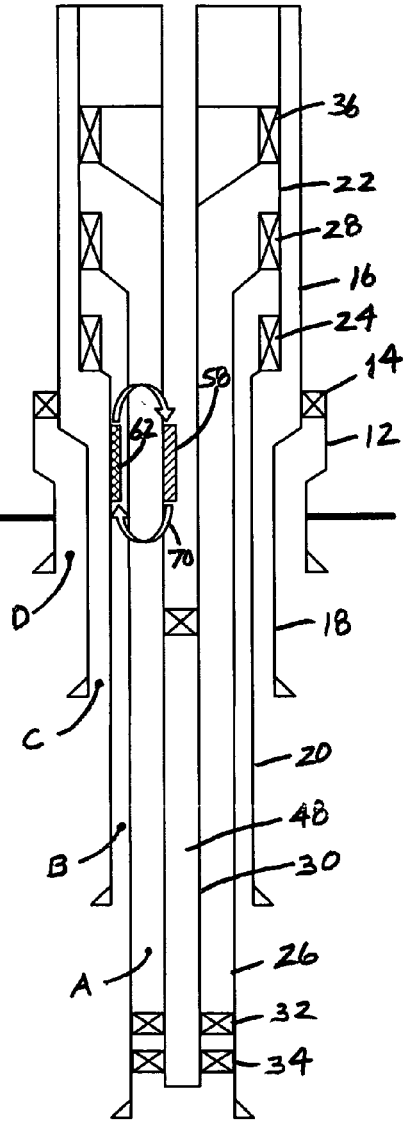
FIG. 5 is a schematic sectional illustration of an exemplary subsea hydrocarbon production system showing an interrogation package located inside the production bore and communicating via a multi-barrier technique with a sensing package located in the B annulus.

In the embodiment of the invention shown in FIG. 5, the interrogation package 58 is located in production bore 48, and a single sensor package 62 is located in the B annulus formed by the intermediate casing 20 and the production casing 26. In this embodiment, the interrogation and response signals, which are indicated by the arrows 70, are transmitted directly across multiple well casings and casing annuli.

Thus, it should be apparent from the embodiments of the invention shown in FIGS. 2 through 5 that the monitoring system of the present invention can be applied to a subsea hydrocarbon production system comprising any number of well casings and corresponding casing annuli, depending on the power and data capabilities of the sensing packages and the available space within the casing annuli.

Communication between the interrogation package 58 and a surface vessel (not shown) may be established using conventional means, such as a dedicated control umbilical or a wireless communications device, or through the existing control and instrumentation infrastructure of the subsea hydrocarbon production system utilizing spare ports within the subsea control module, as is known in the art.

Power for the interrogation package 58 can be obtained from existing subsea power supplies, energy harvesting techniques or local energy storage devices, as is known in the art. In addition, power for the sensing packages 60, 62 and 64 can be obtained from energy harvesting techniques (employing, for example, the Seebeck Effect or pressure variations), or from local energy storage devices, such as capacitive devices or rechargeable or disposable batteries.

In accordance with the present invention, power for the sensing packages 60, 62 and 64 may also be obtained from the external interrogation package 58 using a known inductive power transfer technique. This embodiment employs a modified version of the interrogation and sensing packages which provides both data transfer and power, which may be continual or pulsed to charge in-situ storage systems. The efficiency of the inductive power transfer through the wellhead housing 12 and the well casings 18, 20, 26 and 30 will depend on the material type and thickness of these barriers. As with the NFM communication system of the disclosed invention, the inductive power transfer can be implemented using a multi-hop technique or directly across multiple barriers.

Inductive power transfer is accomplished by coupling magnetic flux between a transmitter located in the interrogation package 58 and a receiver located in a corresponding sensor package 60, 62, 64. In this wireless power transfer technique, the transmitter generates an AC magnetic field, and a portion of the resultant AC magnetic flux flows through the receiver. This in turn causes the receiver to generate an AC current which can be sourced to a power storage device, such as a capacitor. With multiple casings separating the interrogation package 58 from the sensor packages 60, 62, 64, the invention may employ multiple transmitter and receiver pairs, with each pair being located in a corresponding annulus. In this manner, power is delivered through one casing, stored in a capacitor or other known energy storage device, and then delivered through the next casing, and so on until the power is delivered to the innermost sensor package.

In accordance with a further embodiment of the invention, the inductive power transfer technique employs a pulse-powering method. In this technique, a small amount of power is transmitted continuously between the interrogation package 58 and one or more of the sensor packages 60, 62, 64 but is only used periodically. Thus, the capacitor or other energy storage device is continuously charged by the small amount of received power, and when needed (for example when the sensor package is wirelessly interrogated), this stored energy is used in a single burst to read the sensor and wirelessly transmit the reading. After exhausting the stored energy, the sensor package would then allow the energy to be replenished before being ready for another read/transmit cycle.

It should be recognized that, while the present invention has been described in relation to the preferred embodiments thereof, those skilled in the art may develop a wide variation of structural and operational details without departing from the principles of the invention. For example, the various elements shown in the different embodiments may be combined in a manner not illustrated above. Therefore, the appended claims are to be construed to cover all equivalents falling within the true scope and spirit of the invention.

What is claimed is:

1. In a subsea hydrocarbon production system which comprises a wellhead housing mounted at the upper end of a well bore, a number of concentric well casings extending from the wellhead housing through the well bore, including an innermost casing through which a hydrocarbon fluid is produced, and a plurality of casing annuli formed between successive ones of the wellhead housing and the well casings, an improvement comprising a monitoring system for monitoring a parameter existing in at least one of the casing annuli which comprises:

an interrogation package which is operable to wirelessly transmit an interrogation signal; and at least one sensing package which is located in a corresponding casing annulus and which includes at least one sensor for sensing the parameter, the sensing package being operable to wirelessly receive the interrogation signal and in response thereto wirelessly transmit a response signal to the interrogation package which is indicative of the parameter sensed by the sensor;

wherein the interrogation package communicates with the at least one sensing package using near-field magnetic induction (NFM) signals.

2. The subsea hydrocarbon production system of claim 1, wherein the interrogation package is located externally of the wellhead housing.

3. The subsea hydrocarbon production system of claim 2, wherein the sensing package is located in one of the casing annuli.

4. The subsea hydrocarbon production system of claim 3, wherein the interrogation signals are transmitted directly between the interrogation package and the sensing package.

5. The subsea hydrocarbon production system of claim 2, wherein the at least one sensing package comprises a plurality of sensing packages, each of which is located in a corresponding casing annulus.

6. The subsea hydrocarbon production system of claim 1, wherein each sensing package comprises a plurality of sensors for monitoring corresponding parameters in the casing annuli.

7. The subsea hydrocarbon production system of claim 1, further comprising means for powering the interrogation package.

8. The subsea hydrocarbon production system of claim 1, further comprising means for powering the sensing package.

9. The subsea hydrocarbon production system of claim 8, wherein the means for powering the sensing package comprises a transmitter for generating an AC magnetic field, a receiver which is exposed to the magnetic field and which in response thereto generates an AC current, and an energy storage device which is charged by the current, wherein the energy storage device powers the sensing package.

10. The subsea hydrocarbon production system of claim 9, wherein the transmitter is located in the interrogation package.

11. The subsea hydrocarbon production system of claim 9, wherein the energy storage device is continuously charged by the current and the power stored in the energy storage device is expended by the sensing device in a single burst.

12. The subsea hydrocarbon production system of claim 1, wherein the plurality of casing annuli comprises at least an A annulus and a B annulus, and wherein the interrogation package is located in the A annulus and the sensing package is located in the B annulus.

13. The subsea hydrocarbon production system of claim 1, wherein the plurality of casing annuli comprises at least an A annulus, a B annulus and a C annulus, and wherein the interrogation package is located in the A annulus and the sensing package is located in the C annulus.

14. In a subsea hydrocarbon production system which comprises a wellhead housing mounted at the upper end of a well bore, a number of concentric well casings extending from the wellhead housing through the well bore, including an innermost casing through which a hydrocarbon fluid is produced, and a plurality of casing annuli formed between successive ones of the wellhead housing and the well casings, an improvement comprising a monitoring system for monitoring a parameter existing in at least one of the casing annuli which comprises:

an interrogation package which is operable to wirelessly transmit an interrogation signal; and at least one sensing package which is located in a corresponding casing annulus and which includes at least one sensor for sensing the parameter, the sensing package being operable to wirelessly receive the interrogation signal and in response thereto wirelessly transmit a response signal to the interrogation package which is indicative of the parameter sensed by the sensor;

wherein the interrogation package is located externally of the wellhead housing, the at least one sensing package comprises a plurality of sensing packages, each of which is located in a corresponding casing annulus, and the interrogation signals are transmitted between the interrogation package and the sensing packages using a multi-hop signal transmission technique; and wherein the interrogation package communicates with a radially adjacent sensing package and the sensing packages communicate with each other using near-field magnetic induction (NFM) signals.

15. In a subsea hydrocarbon production system which comprises a wellhead housing mounted at the upper end of a well bore, a number of concentric well casings extending from the wellhead housing through the well bore, including an innermost casing through which a hydrocarbon fluid is produced, and a plurality of casing annuli formed between successive ones of the wellhead housing and the well casings, an improvement comprising a monitoring system for monitoring a parameter existing in at least one of the casing annuli which comprises:

an interrogation package which is operable to wirelessly transmit an interrogation signal; and at least one sensing package which is located in a corresponding casing annulus and which includes at least one sensor for sensing the parameter, the sensing package being operable to wirelessly receive the interrogation signal and in response thereto wirelessly transmit a response signal to the interrogation package which is indicative of the parameter sensed by the sensor;

wherein the interrogation package is located within the innermost casing; and wherein the interrogation package communicates with the at least one sensing package using near-field magnetic induction (NFM) signals.

16. The subsea hydrocarbon production system of claim 15, wherein the sensing package is located in one of the casing annuli.

17. The subsea hydrocarbon production system of claim 16, wherein the interrogation signals are transmitted directly between the interrogation package and the sensing package.

18. The subsea hydrocarbon production system of claim 15, wherein the at least one sensing package comprises a plurality of sensing packages, each of which is located in a corresponding casing annulus.

19. In a subsea hydrocarbon production system which comprises a wellhead housing mounted at the upper end of a well bore, a number of concentric well casings extending from the wellhead housing through the well bore, including an innermost casing through which a hydrocarbon fluid is produced, and a plurality of casing annuli formed between successive ones of the wellhead housing and the well casings, an improvement comprising a monitoring system for monitoring a parameter existing in at least one of the casing annuli which comprises:

an interrogation package which is operable to wirelessly transmit an interrogation signal; and at least one sensing package which is located in a corresponding casing annulus and which includes at least one sensor for sensing the parameter, the sensing package being operable to wirelessly receive the interrogation signal and in response thereto wirelessly transmit a response signal to the interrogation package which is indicative of the parameter sensed by the sensor;

wherein the interrogation package is located within the innermost casing, the at least one sensing package comprises a plurality of sensing packages, each of which is located in a corresponding casing annulus, and the interrogation signals are transmitted between the interrogation package and the sensing packages using a multi-hop signal transmission technique; and wherein the interrogation package communicates with a radially adjacent sensing package and the sensing packages communicate with each other using near-field magnetic induction (NFM) signals.

20. In a subsea hydrocarbon production system which comprises a wellhead housing mounted at the upper end of a well bore, a number of concentric well casings extending from the wellhead housing through the well bore, including an innermost casing through which a hydrocarbon fluid is produced, and a plurality of casing annuli formed between successive ones of the wellhead housing and the well casings, an improvement comprising a monitoring system for monitoring a parameter existing in at least one of the casing annuli which comprises:

an interrogation package which is operable to wirelessly transmit an interrogation signal; and at least one sensing package which is located in a corresponding casing annulus and which includes at least one sensor for sensing the parameter, the sensing package being operable to wirelessly receive the interrogation signal and in response thereto wirelessly transmit a response signal to the interrogation package which is indicative of the parameter sensed by the sensor; and means for powering the sensing package, said means comprising a transmitter for generating an AC magnetic field, a receiver which is exposed to the magnetic field and which in response thereto generates an AC current, and an energy storage device which is charged by the current, wherein the energy storage device powers the sensing package;

wherein the monitoring system comprises a plurality of sensing packages, each of which is positioned in a corresponding casing annulus, and wherein the means for powering the sensing packages comprises a plurality of transmitters and receivers arranged in transmitter/receiver pairs, each transmitter/receiver pair being positioned in a corresponding casing annulus and being connected to a corresponding energy storage device which in turn is connected to a corresponding sensing package, wherein power for at least one sensing package is transmitted to its corresponding transmitter/receiver pair by the transmitter/receiver pair of a radially adjacent sensing package.

* * * * *